US010323896B2

(12) United States Patent
Morris, Jr.

(10) Patent No.: US 10,323,896 B2
(45) Date of Patent: Jun. 18, 2019

(54) FLASH REDIRECTING RECOIL COMPENSATOR

(71) Applicant: James Morris, Jr., Fayetteville, NC (US)

(72) Inventor: James Morris, Jr., Fayetteville, NC (US)

( * ) Notice: Subject to any disclaimer, the term of this patent is extended or adjusted under 35 U.S.C. 154(b) by 0 days.

(21) Appl. No.: 13/965,816

(22) Filed: Aug. 13, 2013

(65) Prior Publication Data

US 2014/0075800 A1 Mar. 20, 2014

Related U.S. Application Data

(60) Provisional application No. 61/684,915, filed on Aug. 20, 2012.

(51) Int. Cl.
*F41A 21/36* (2006.01)
*F41A 21/34* (2006.01)

(52) U.S. Cl.
CPC ..... *F41A 21/36* (2013.01); *F41A 21/34* (2013.01)

(58) Field of Classification Search
CPC ..... F41A 21/34; F41A 21/36; F41A 21/38; F41A 21/325
USPC ..... 89/14.2, 14.3
See application file for complete search history.

(56) References Cited

U.S. PATENT DOCUMENTS 4,691,614 A * 9/1987 Leffel et al. ..... 89/14.3
5,435,089 A * 7/1995 Rodney, Jr. ..... 42/51
5,549,030 A * 8/1996 Lespron ..... 89/14.3

FOREIGN PATENT DOCUMENTS

DE 94 02 329.8 * 8/1994

* cited by examiner

*Primary Examiner* — Stephen Johnson

(57) ABSTRACT

A flash redirecting recoil compensator for a firearm includes a compensator body that provides a platform for the rest of the components. The compensator body attaches with a firearm in order to reduce recoil force and redirect the muzzle flash away from the site of the shooter. An attachment chamber and a discharge chamber of the compensator body are positioned through a top portion of the compensator body from a rear face to a front face. The attachment chamber fastens the compensator body into the firearm while the discharge chamber provides space for the discharging bullet. At least two vectoring ports, which are traversed through the compensator body and into the discharge chamber, redirect hot gas and unspent propellants away from the firearm after the bullet is discharged as the redirection of the hot gas and unspent propellants reduce the recoil force and provide a clear shooting sight.

17 Claims, 10 Drawing Sheets

SECTION A-A
SCALE 3 : 1

SECTION A-A
SCALE 2 : 1

FLASH REDIRECTING RECOIL COMPENSATOR

The current application claims a priority to the U.S. Provisional Patent application Ser. No. 61/684,915 filed on Aug. 20, 2012.

FIELD OF THE INVENTION

The present invention relates generally to firearm attachments. More specifically the present invention is a flash redirecting recoil compensator which is mounted on the barrel of a firearm and thereby reduces recoil of the firearm by redirecting the hot gasses expelled from the barrel.

BACKGROUND OF THE INVENTION

Firearms are widely used by militaries, law enforcement agencies, and even private citizens around the world. The purpose of firearms ranges from eliminating hostile threats with vicious efficiency to upholding law and order, and even putting food on the table for some. Recoil is constant concern when discharging a firearm that is governed by the simple law of physics that every action causes an equal and opposite reaction. In the case of recoil, the action of the bullet being propelled forwards at extreme velocities causes the equal and opposite reaction of the firearm recoiling backwards in the direction opposite the bullet was fired in. The forces associated with recoil can create a number of problems when a shooter is trying to maintain accuracy when firing their weapon. While the accuracy of the first shot is largely unaffected by the recoil of the firearm, the accuracy of all subsequent shots is drastically affected, especially with fully automatic firearms. If the shooter wishes to maintain accuracy, they must contend with the recoil of their firearm, and take the time to regain their sight picture as well as firing in shorter more controlled bursts of fire. Overcoming recoil has been a problem since the introduction of rapid firing semi automatic and fully automatic firearms and as such, many solutions to the problem have historically been developed and used. One of the most common solutions to the problem of high recoil is called a recoil compensator or muzzle brake. Muzzle brakes and recoil compensators redirect the force of the hot gas and unburned powder being expelled from the barrel of the firearm to counter the recoil of the firearm. There are two components to recoil which are generated by the discharge of the firearm; the barrel is pushed linearly backwards, and the barrel raises as a result of the reactions forces where the shooter is holding the firearm. Barrel rise is extremely prominent in pistols as the recoil force causes a reaction force where the shooter is holding the firearm; the reaction force in pistols is vertically offset from the backwards recoil force and thus a movement is generated, causing the pistol's barrel to rise significantly. Recoil compensators aim to counter this effect by vectoring portions of the hot gas and unburned powder upwards when the firearm is discharged. The forces generated by the hot gas and unburned powder expelled upwards causes a movement which is counter rotational to that caused by the recoil. Thus a portion of the movement caused by the recoil is cancelled out, thereby allowing the shooter to more quickly regain the original sight picture, or acquire a new one. The positive effect of recoil compensators using this configuration is accompanied by the unfortunate effect of directing the bright flash of the discharging gas and powder into the sight path of the shooter. This is extremely unfortunate when the shooter is in lowlight conditions as the bright flash of light directed into the sight picture can cause night blindness and loss of the sight picture entirely. This adverse effect can even be life threatening to a soldier or law enforcement agent who is relying upon a clear line of sight to the target resolve deadly situations.

Therefore, it is an object of the present invention to provide a recoil compensator which serves to reduce barrel rise caused by recoil while simultaneously preventing the flash of the firearm from completely obscuring the sight picture. This combination provides the shooter with maximum efficiency of both maintaining their sight picture, and keeping the firearm on target. Additionally, it is an object of the present invention to be easily installed on a firearm without the need for significant modification of said firearm. The present invention is also compatible with combat holsters when equipped on the firearm.

DETAIL DESCRIPTIONS OF THE INVENTION

All illustrations of the drawings are for the purpose of describing selected versions of the present invention and are not intended to limit the scope of the present invention.

Figure 1:
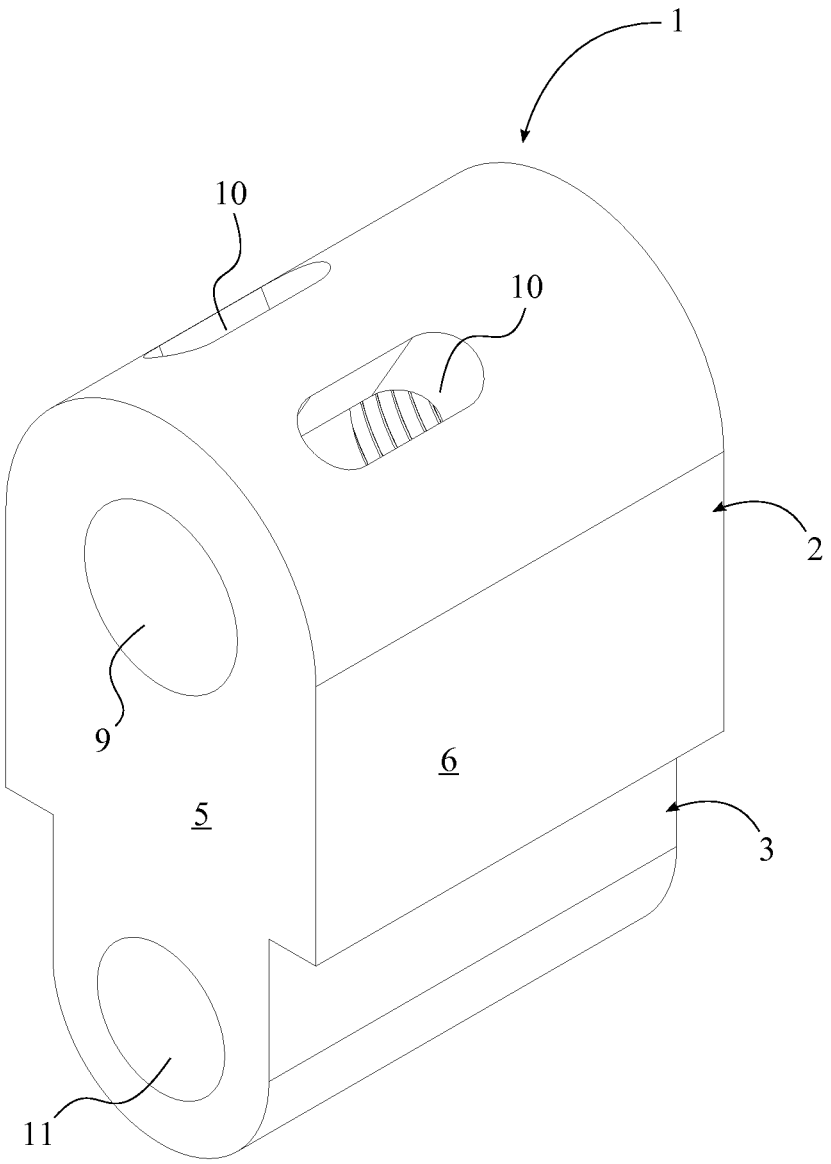
FIG. 1 is a front perspective view of the present invention.
Figure 2:
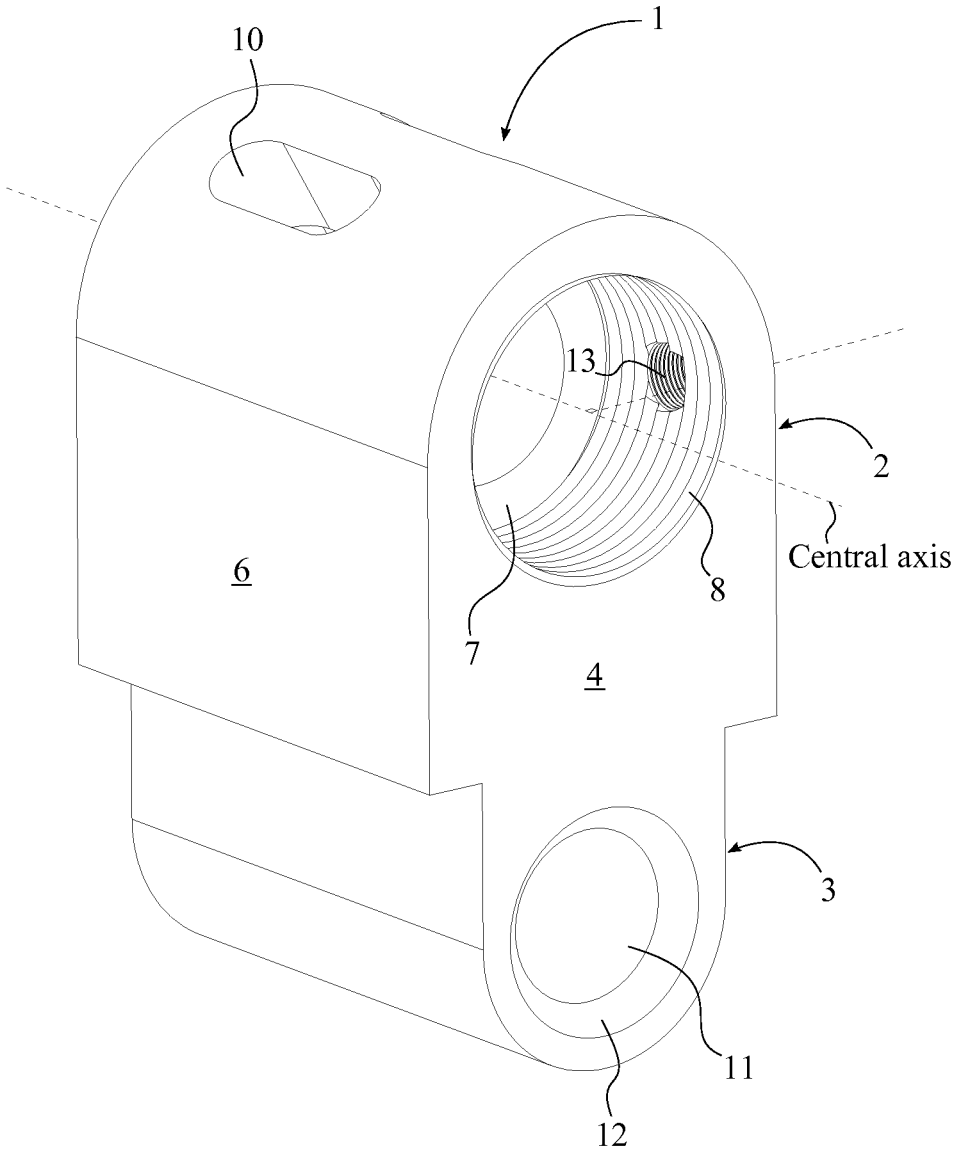
FIG. 2 is a rear perspective view of the present invention.
Figure 3:
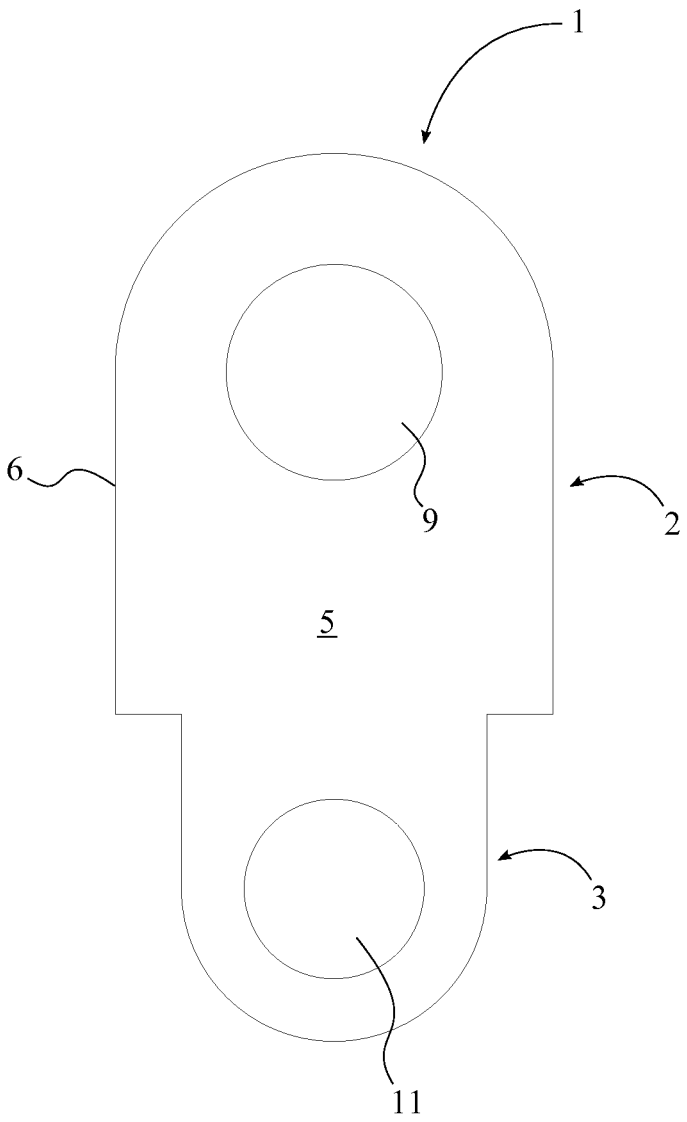
FIG. 3 is a front view of the present invention.
Figure 4:
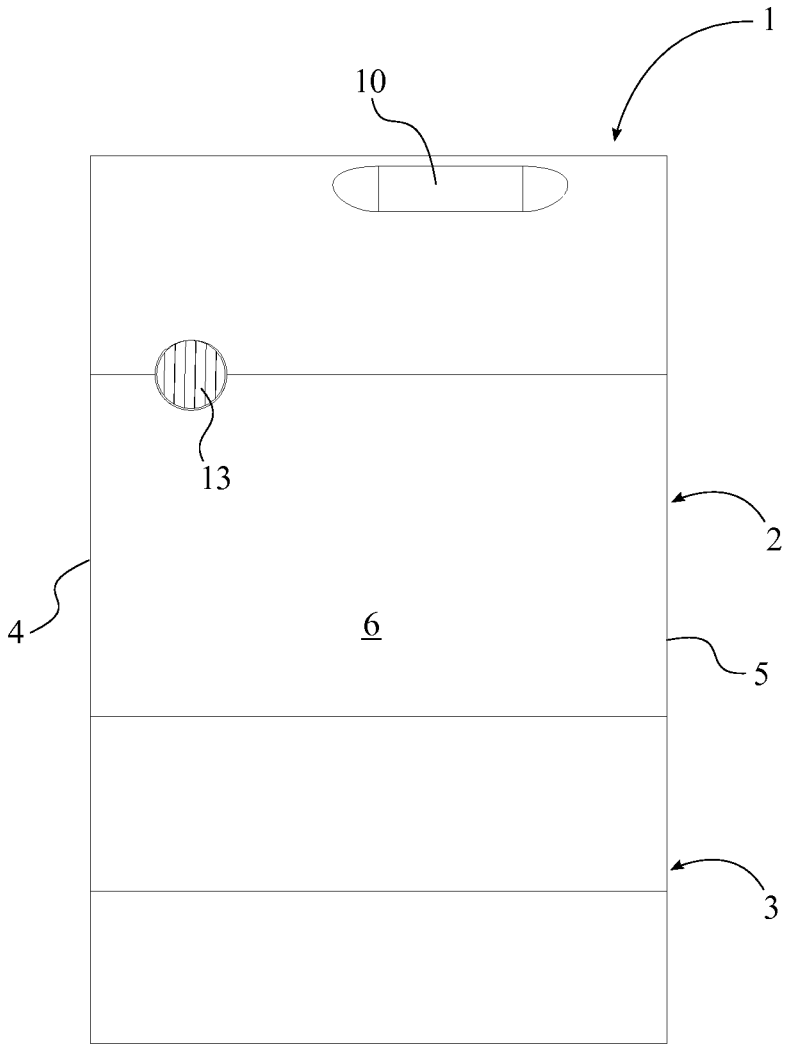
FIG. 4 is a side view of the present invention.
Figure 5:
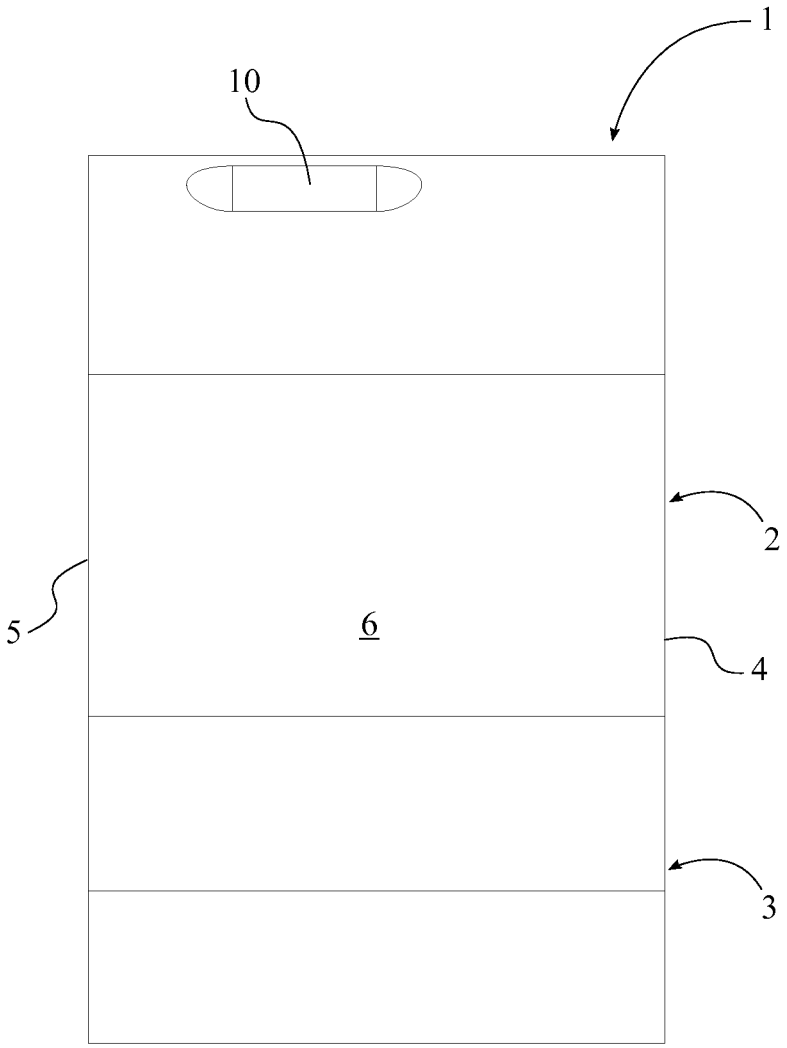
FIG. 5 is an opposite side of the present invention.

In reference to FIG. 1 and FIG. 2, the present invention is a flash redirecting recoil compensator which comprises a compensator body 1, an attachment chamber 7, a discharge chamber 9, at least two vectoring ports 10, a guide rod hole 11, and a screw hole 13. The present invention is mounted directly onto a gun barrel of a firearm without the use of an expansion chamber, where the present invention drastically reduces the recoil of the firearm while redirecting the muzzle flash away from the sight of the shooter.

In reference to FIG. 1-FIG. 5, the compensator body 1 is the primary component of the present invention as all of the other components of the present invention are either positioned or attached to the compensator body 1. The compensator body 1 comprises a top portion 2, a bottom portion 3, a rear face 4, a front face 5, and a lateral face 6. The top portion 2 is positioned atop the bottom portion 3, where the top portion 2 and the bottom portion 3 complete the compensator body 1. The front face 5 and the rear face 4 are oppositely positioned from each other on the compensator body 1, and the front face 5 and the rear face 4 are vertically expanded along the top portion 2 and the bottom portion 3. The lateral face 6 is positioned around the compensator body 1 in between the front face 5 and the rear face 4, where the lateral face 6 is perpendicularly positioned with the front face 5 and the rear face 4 and horizontally expanded along the top portion 2 and the bottom portion 3. The compensator body 1 can be made from wide range of high strength materials with metals being the most suited so that the compensator body 1 can withstand the stresses from the discharge of the firearm as the high pressure associated with the hot gas and unspent propellants create stresses on the compensator body 1. The manufactured materials of the compensator body 1 should also be able to withstand the incorporation of the other components of the present invention and their functionalities.

Figure 12:
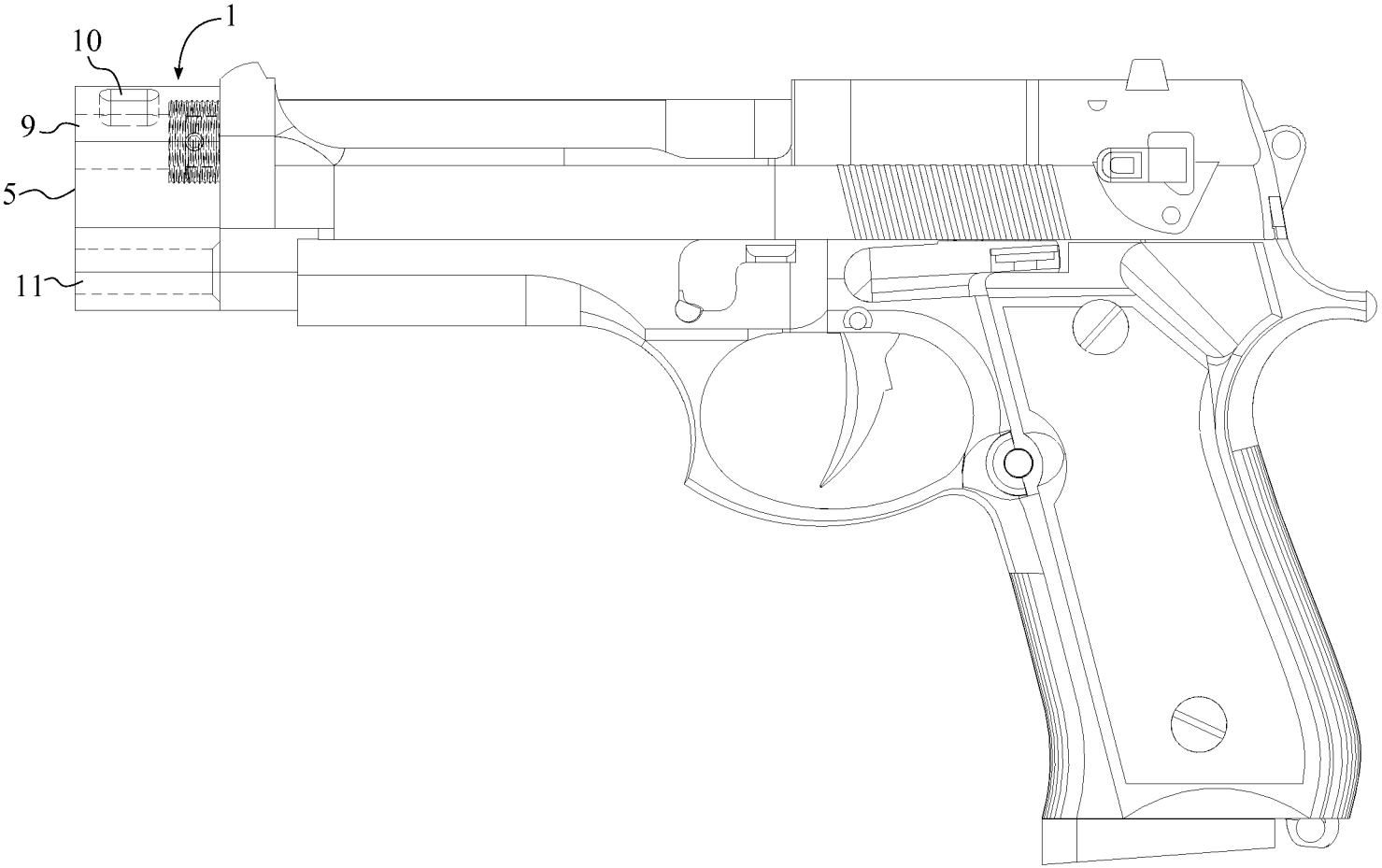
FIG. 12 is a perspective view of the present invention, showing the present invention being attached with a firearm.

In reference to FIG. 8-FIG. 11, the attachment chamber 7, which comprises a bottom tapped female thread 8, is traversed onto the top portion 2 from the rear face 4 for some distance, and the bottom tapped female thread 8 is extended into the attachment chamber 7 from the rear face 4, where the bottom tapped female thread 8 is helically positioned within the attachment chamber 7. The discharge chamber 9 is traversed into the top portion 2 from the front face 5 and positioned against the attachment chamber 7 in such way that the discharge chamber 9 is concentrically positioned with the attachment chamber 7. Due to the fact, the discharge chamber 9 and the attachment chamber 7 meet within the compensator body 1; the discharge chamber 9 and the attachment chamber 7 create an opening from the rear face 4 to front face 5. As shown in FIG. 12, the attachment chamber 7 and the bottom tapped female thread 8 of the present invention function as the fastening mechanism in between the present invention and the firearm. More specifically, the attachment chamber 7 and the bottom tapped female thread 8 of the present invention attach the present invention with the gun barrel of the firearm, where the depth of the attachment chamber 7 is determined by the depth of the gun barrel that is enclosed by the attachment chamber 7. The users of the firearm have to thread the gun barrel of the firearm so that the bottom tapped female thread 8 is able to engage with the barrel thread. When the present invention is attached with the firearm through the attachment chamber 7, the bottom tapped female thread 8, and the barrel thread, the end of gun barrel is positioned flush against the inside end of the attachment chamber 7. The diameter of the attachment chamber 7 is larger than the diameter of the discharge chamber 9 so that the attachment chamber 7 can account for the diameter of the gun barrel, and the discharge chamber 9 can account for the diameter of the gun barrel opening. As a result, a bullet from the firearm can travel through the present invention and out into free air, where the bullet travels onward to the target at which it was fired. The diameter of the discharge chamber 9 is determined with a tight tolerance such that the bullet is able to pass through the present invention without obstructions as any obstructions would result in catastrophic failure of the present invention and possibly even harming the shooter.

Figure 9:
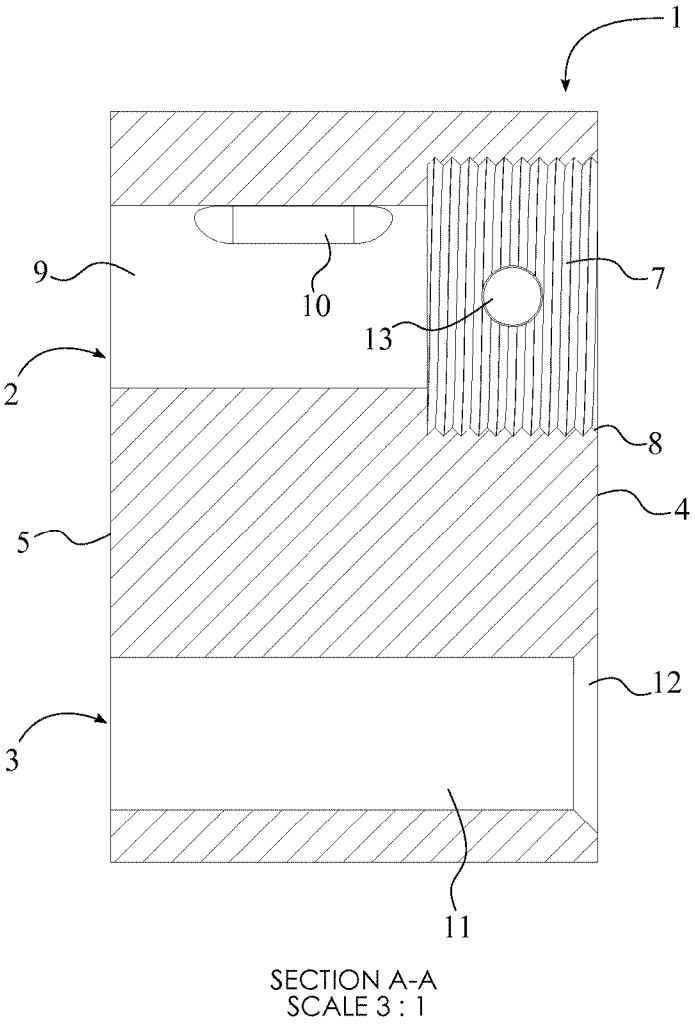
FIG. 9 is a cross section view thereof taken along line A-A of FIG. 8.
Figure 8:
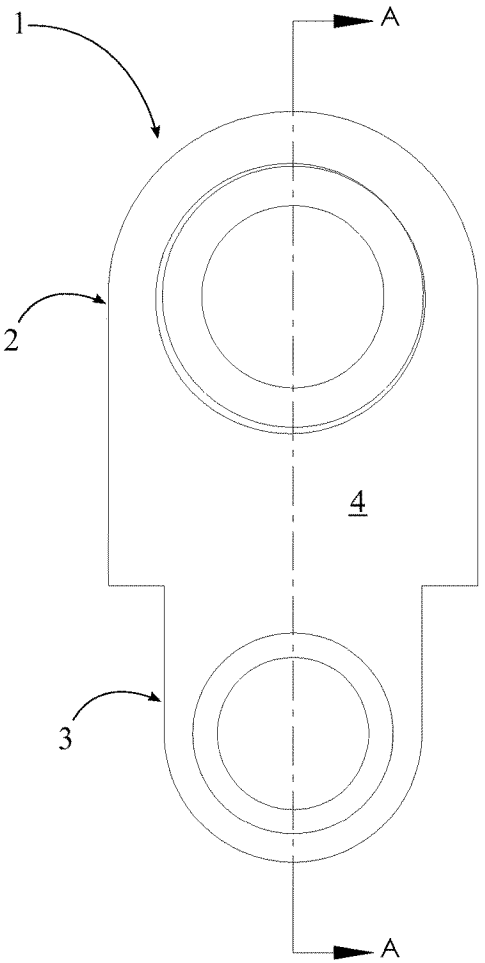
FIG. 8 is a rear view of the present invention, showing the plane upon which a cross sectional view is taken shown in FIG. 9.
Figure 11:
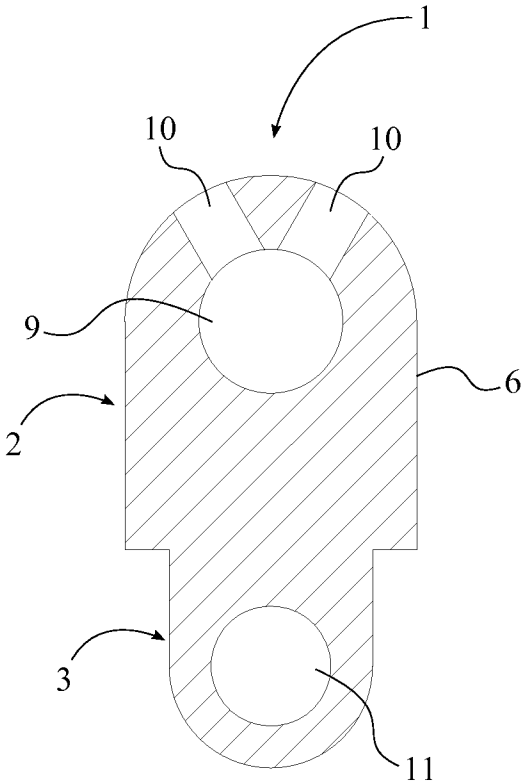
FIG. 11 is a cross section view thereof taken along line A-A of FIG. 10.
Figure 10:
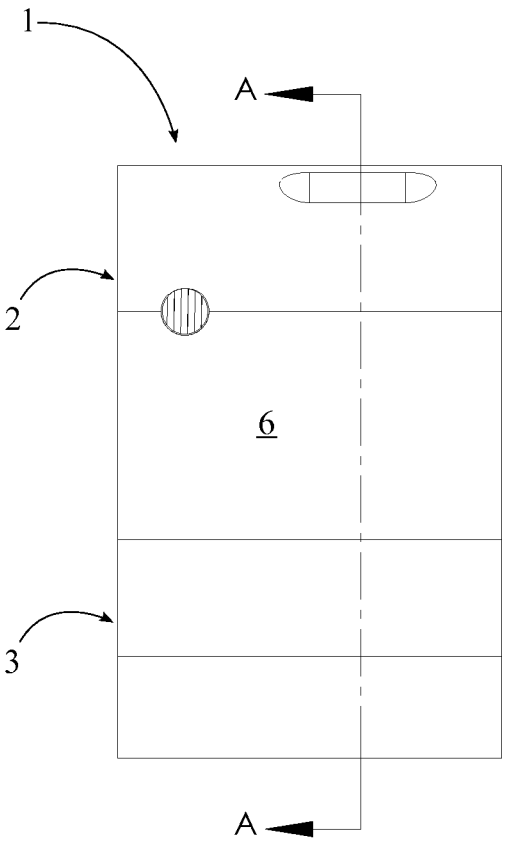
FIG. 10 is a side view of the present invention, showing the plane upon which a cross sectional view is taken shown in FIG. 11.

In reference to FIG. 2 and FIG. 9, the screw hole 13 is traversed through the compensator body 1 and into the attachment chamber 7. The screw hole 13 is perpendicularly positioned with a central axis of the attachment chamber 7. A hex screw can be inserted into the screw hole 13, where the hex screw engages with the screw hole 13, protrudes into the attachment chamber 7, and presses against the gun barrel, thus providing additional securing in between the present invention and the gun barrel.

Even though the present invention uses the hex screw and the bottom tapped female thread 8 to secure the compensator body 1 with the firearm, it is also contemplated that a number of other different methods may be employed to secure the present invention to the firearm. Alternative methods include, but are not limited, permanent securing of the present invention to the firearm during production and permanent retrofitting of the present invention to the firearm through metal fabricating.

Figure 6:
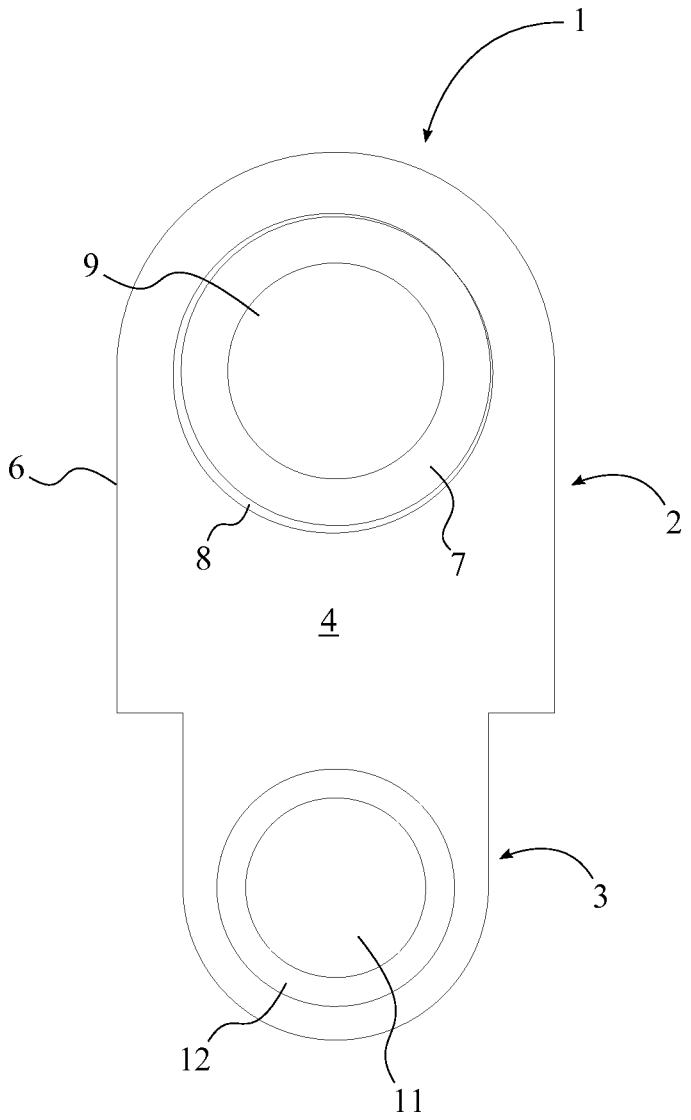
FIG. 6 is a rear view of the present invention.

In reference to FIG. 2, FIG. 6, and FIG. 9, the guide rod hole 11 is traversed through the bottom portion 3 from the front face 5 to the rear face 4, where the guide rod hole 11 provides a path to a guide rod of the firearm so that the guide rod can safely move in and out from the firearm without damaging or hitting the present invention. The guide rod hole 11 is linearly positioned below the attachment chamber 7, and a chamfered edge 12 of the guide rod hole 11 is adjacently positioned in between the rear face 4 and the guide rod hole 11.

Figure 7:
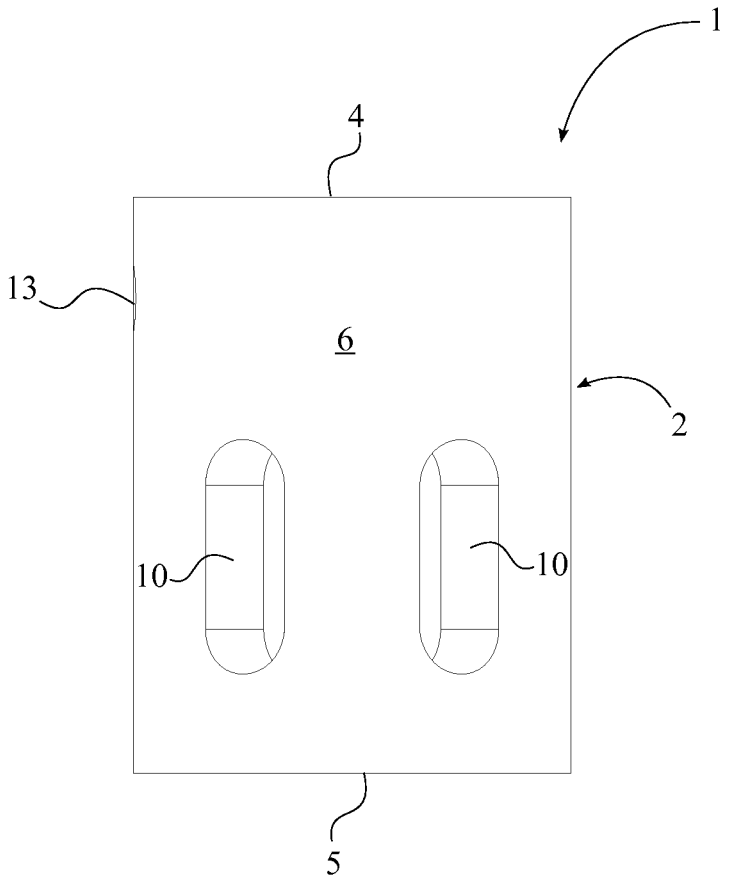
FIG. 7 is a top view of the present invention.

In reference to FIG. 1 and FIG. 7, the at least two vectoring ports 10 are traversed through the compensator body 1 and into the discharge chamber 9, where the at least two vectoring ports 10 redirect the hot gas and the unspent propellants that create the muzzle flash away from the sight of the shooter while reducing the recoil of the firearm. The at least two vectoring ports 10 are angularly positioned from each other within the top portion 2. The angle between the at least two vectoring ports 10 of the present invention is preferably 60 degrees from a central axis of the attachment chamber 7 so that the present invention can perform up to its optimal capacity. Even though the angle between the at least two vectoring ports 10 of the present invention is preferably 60 degrees, the angle and the number of vectoring ports 10 of alternative embodiments of the present invention can be different with respect to different firearms in order to maximize the effectiveness of the present invention. When the firearm is discharged by the shooter, the hot gas and unspent propellants expand outwards behind the bullet, and when the bullet passes through the discharge chamber 9 of the present invention, the gas and unspent propellants are allowed to escape from behind the bullet via the at least two vectoring ports 10.

When a firearm is discharged without the present invention, recoil of the firearm occurs because of the forces generated by the expulsion of the hot gas and unspent propellants. The recoil of the firearm compromises the accuracy of the firearm in between each bullet discharge and also creates discomfort to the shooter as the recoil of the firearm linearly pushes back the firearm and raises the gun barrel. When a firearm is discharged with the present invention, the positioning of the at least two vectoring ports 10 harnesses and discharges the hot gas and unspent propellants through the at least two vectoring ports 10 in such way that the recoil of the firearm is both central and downward. Due to fact that the recoil of the firearm is redirected toward the central and downward directions, the recoil experienced by the shooter is drastically reduced when the present invention is attached to the firearm. An additional effect of the at least two vectoring ports 10 is the fact that the muzzle flash perceived by the shooter of the firearm is directed out and away from the sight picture of the firearm, thus preventing the shooter from experiencing obstructed view and or night blindness. Night blindness is a problem that can occur when shooting in low light conditions, and especially when using traditional recoil compensators. Many traditional recoil compensators direct the hot gas and propellants which are responsible for the bright muzzle flash directly into the sight picture of the firearm. Looking directly at this muzzle flash can greatly decrease the vision of the shooter, and even cause temporary blindness due to the drastic contrast in between the muzzle flash and the surrounding gloom. The present invention solves this problem by use of the at least two vectoring ports 10 which direct the muzzle flash out and away from the sight picture. Most of the traditional compensators required expansion chambers in order to slow down the escaping hot gas and propellants so that the accuracy can be maintained throughout the discharge of the firearm. The present invention does not require the expansion chamber as the least two vectoring ports 10 slow down the escaping hot gas and propellants from the present invention while maintaining the accuracy in between each firing rounds of the firearm. Elimination of the expansion chamber also reduces additional weight away from the firearm providing a comfortable grip for the shooters of the present invention.

As shown in FIG. 1-FIG. 12, in a preferred embodiment of the present invention, the top portion 2 comprises a top rectangular section and a top hemi circular section, and the bottom portion 3 comprises a bottom rectangular section and a bottom hemi circular section. The width of the top rectangular section is larger than the width of the bottom rectangular section, where the positioning of the top rectangular section and the bottom rectangular section create a notch on both sides of the compensator body 1 of the preferred embodiment. The top hemi circular section is adjacently positioned with the top rectangular section and opposite from the bottom rectangular section. The bottom hemi circular section is adjacently positioned with the bottom rectangular section and opposite from the top rectangular section. The diameter of the top hemi circular section is equal to the width of the top rectangular section while the diameter of the bottom hemi circular section is equal to the width of the bottom rectangular section. The preferred embodiment of the present invention is designed for use with a Berretta 9 mm handgun called the Berretta 92FS or by its military designation the M9. The guide rod hole 11 of the preferred embodiment enables the guide rod of the 92FS to protrude into the guide rod hole 11 slightly pass the rear face 4 when the firearm is discharged. The 92FS has a portion of the gun barrel that protrudes past the slide, and it is to this section of the gun barrel that the preferred embodiment is attached. The attachment chamber 7 is of the correct depth such that the end of the gun barrel is positioned flush with the end of the attachment chamber 7 and the slide of the 92FS is flush against the rear face 4 of the compensator body 1. The users of the preferred embodiment need to thread the portion of the gun barrel that encloses by the attachment chamber 7 so that the bottom tapped female thread 8 can engage with the threaded portion of the gun barrel, securing the preferred embodiment with the 92FS. The angle of the at least two vectoring ports 10 of the preferred embodiment is 60 degrees for the optimal use of the 92FS.

Although the invention has been explained in relation to its preferred embodiment, it is to be understood that many other possible modifications and variations can be made without departing from the spirit and scope of the invention as hereinafter claimed.

What is claimed is:

1. A flash redirecting recoil compensator for a firearm comprises:

a compensator body comprising:

an attachment chamber;

a discharge chamber;

at least two vectoring ports;

a guide rod hole;

a screw hole;

a top portion;

a bottom portion;

a front face;

a rear face;

two lateral faces;

the attachment chamber comprises a female thread;

the guide rod hole comprises a chamfered edge;

the attachment chamber traverses into the top portion from the rear face;

the discharge chamber traverses into the top portion from the front face;

the discharge chamber is positioned directly against the attachment chamber;

the attachment chamber has an attachment diameter constantly formed therethrough;

the discharge chamber has a discharge diameter constantly formed therethrough; and the attachment diameter is larger than the discharge diameter.

2. The flash redirecting recoil compensator for a firearm as claimed in claim 1 comprises:

the top portion being vertically positioned atop the bottom portion, wherein the top portion and the bottom portion form the compensator body;

the front face and the rear face being oppositely positioned from each other on two ends of the compensator body, respectively;

the two lateral faces being oppositely positioned from each other on two sides of the compensator body in between the front face and the rear face;

the two lateral faces each being perpendicularly positioned with the front face and the rear face;

the front face and the rear face each being vertically expanded from the top portion to the bottom portion; and the two lateral faces each being vertically expanded from the top portion to the bottom portion.

3. The flash redirecting recoil compensator for a firearm as claimed in claim 1 comprises:

the female thread being extended into the attachment chamber from the rear face;

the female thread being helically formed within the attachment chamber; and the discharge chamber being concentrically positioned with the attachment chamber.

4. The flash redirecting recoil compensator for a firearm as claimed in claim 1 comprises:

the at least two vectoring ports traversing through the compensator body and into the discharge chamber; and the at least two vectoring ports being angularly positioned from each other within the top portion.

5. The flash redirecting recoil compensator for a firearm as claimed in claim 1 comprises:

the guide rod hole traversing through the bottom portion from the front face to the rear face;

the guide rod hole being linearly positioned below the attachment chamber; and the chamfered edge being adjacently positioned in between the rear face and the guide rod hole.

6. The flash redirecting recoil compensator for a firearm as claimed in claim 1 comprises:

the screw hole traversing through the compensator body and into the attachment chamber; and the screw hole being perpendicularly positioned with a central axis of the attachment chamber.

7. A flash redirecting recoil compensator for a firearm comprises:

a compensator body comprising:

an attachment chamber;

a discharge chamber;

at least two vectoring ports;

a guide rod hole;

a screw hole;

a top portion;

a bottom portion;

a front face;

a rear face;

two lateral faces;

the attachment chamber comprises a female thread;

the guide rod hole comprises a chamfered edge;

the top portion being vertically positioned atop the bottom portion, wherein the top portion and the bottom portion form the compensator body;

the front face and the rear face being oppositely positioned from each other on two ends of the compensator body, respectively;

the attachment chamber traverses into the top portion from the rear face;

the discharge chamber traverses into the top portion from the front face;

the discharge chamber is positioned directly against the attachment chamber;

the attachment chamber has an attachment diameter constantly formed therethrough;

the discharge chamber has a discharge diameter constantly formed therethrough; and the attachment diameter is larger than the discharge diameter.

8. The flash redirecting recoil compensator for a firearm as claimed in claim 7 comprises:

the two lateral faces being oppositely positioned from each other on two sides of the compensator body in between the front face and the rear face;

the two lateral faces each being perpendicularly positioned with the front face and the rear face;

the front face and the rear face each being vertically expanded from the top portion to the bottom portion; and the two lateral faces each being vertically expanded from the top portion to the bottom portion.

9. The flash redirecting recoil compensator for a firearm as claimed in claim 7 comprises:

the female thread being extended into the attachment chamber from the rear face;

the female thread being helically formed within the attachment chamber;

the discharge chamber being concentrically positioned with the attachment chamber.

10. The flash redirecting recoil compensator for a firearm as claimed in claim 7 comprises:

the at least two vectoring ports traversing through the compensator body and into the discharge chamber; and the at least two vectoring ports being angularly positioned from each other within the top portion.

11. The flash redirecting recoil compensator for a firearm as claimed in claim 7 comprises:

the guide rod hole traversing through the bottom portion from the front face to the rear face;

the guide rod hole being linearly positioned below the attachment chamber; and the chamfered edge being adjacently positioned in between the rear face and the guide rod hole.

12. The flash redirecting recoil compensator for a firearm as claimed in claim 7 comprises:

the screw hole traversing through the compensator body and into the attachment chamber; and the screw hole being perpendicularly positioned with a central axis of the attachment chamber.

13. A flash redirecting recoil compensator for a firearm comprises:

a compensator body comprising:

a discharge chamber;

at least two vectoring ports;

a guide rod hole;

a screw hole;

a top portion;

a bottom portion;

a front face;

a rear face;

two lateral faces;

the attachment chamber comprises a female thread;

the guide rod hole comprises a chamfered edge;

the top portion being vertically positioned atop the bottom portion, wherein the top portion and the bottom portion form the compensator body;

the front face and the rear face being oppositely positioned from each other on two ends of the compensator body, respectively;

the two lateral faces each being oppositely positioned from each other on two sides of the compensator body in between the front face and the rear face;

the two lateral faces each being perpendicularly positioned with the front face and the rear face;

the front face and the rear face each being vertically expanded from the top portion to the bottom portion; and the two lateral faces each being vertically expanded from the top portion to the bottom portion;

the attachment chamber traverses into the top portion from the rear face;

the discharge chamber traverses into the top portion from the front face;

the discharge chamber is positioned directly against the attachment chamber;

the attachment chamber has an attachment diameter constantly formed therethrough;

the discharge chamber has a discharge diameter constantly formed therethrough; and the attachment diameter is larger than the discharge diameter.

14. The flash redirecting recoil compensator for a firearm as claimed in claim 13 comprises:

the female thread being extended into the attachment chamber from the rear face;

the female thread being helically formed within the attachment chamber; and the discharge chamber being concentrically positioned with the attachment chamber.

15. The flash redirecting recoil compensator for a firearm as claimed in claim 13 comprises:

the at least two vectoring ports traversing through the compensator body and into the discharge chamber; and the at least two vectoring ports being angularly positioned from each other within the top portion.

16. The flash redirecting recoil compensator for a firearm as claimed in claim 13 comprises:

the guide rod hole traversing through the bottom portion from the front face to the rear face;

the guide rod hole being linearly positioned below the attachment chamber; and the chamfered edge being adjacently positioned in between the rear face and the guide rod hole.

17. The flash redirecting recoil compensator for a firearm as claimed in claim 13 comprises:

the screw hole traversing through the compensator body and into the attachment chamber; and the screw hole being perpendicularly positioned with a central axis of the attachment chamber.

* * * * *